US006275131B1

(12) United States Patent
Swope et al.

(10) Patent No.: US 6,275,131 B1
(45) Date of Patent: Aug. 14, 2001

(54) PROCESS FOR VARIABLE INDUCTOR USING NICKEL TITANIUM AND PLACEMENT

(75) Inventors: Charles B. Swope, Coral Springs; Henry F. Liebman, Tamarac; Patrick D. Koskan, Lake Worth, all of FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/454,967

(22) Filed: Dec. 6, 1999

(51) Int. Cl.[7] ..... H01F 21/02
(52) U.S. Cl. ..... 336/20
(58) Field of Search ..... 336/222, 20, 10, 336/192, 107, 223

(56) References Cited

U.S. PATENT DOCUMENTS 3,152,312 * 10/1964 Johnson ..... 336/20
3,648,205 * 3/1972 Bunch et al. ..... 336/20
4,825,184 * 4/1989 Bloch et al. ..... 336/20
5,012,125 * 4/1991 Conway ..... 307/149
5,889,340 * 3/1999 Miller et al. ..... 336/198

* cited by examiner

*Primary Examiner*—Lincoln Donovan
*Assistant Examiner*—Taylor T. Nguyen
(74) *Attorney, Agent, or Firm*—Frank M. Scutch, III

(57) ABSTRACT

A variable inductor is made from two elements separated by an insulating layer. The first element is elastic and serves as a coil shaped support for the inductive element. This elastic element is made with a memory and can be made to change its size by the application of heat. The inductive element is formed over the coil shaped support by layering a thin layer of a highly conductive material such as gold over the insulator layered on the elastic element. As heat is applied to the coil or as an electric current is applied to the elastic element, the size of the coil shaped support is changed which changes the inductive value of the inductive element formed by the conductive layer.

14 Claims, 2 Drawing Sheets

PROCESS FOR VARIABLE INDUCTOR USING NICKEL TITANIUM AND PLACEMENT

TECHNICAL FIELD

This invention relates in general to variable inductors, and more particularly to variable inductors whose shape and inductance can be changed by the application of internal or external heat and without significantly increasing the inductor's series resistance as related to the Quality Factor (Q) of said inductor.

BACKGROUND

As is well known in the art, an inductor, such as an inductor used in an RF tunable circuit, shows an inductive value based on its physical characteristics of length, diameter, number of turns and wire thickness. Once those physical characteristic were set, changing the tuned frequency of the circuit required changing a circuit component such as the circuit inductance or capacitance. Changing the inductance requires switching to a new inductor or altering the properties of the inductance in some other way such as changing the magnetic properties of the inductor core by adding a magnetic material into the inductor's core, such as soft iron, or increasing the separation between the individual coils of the inductor. These physical changes were managed by moving a magnetic material into or out of the inductor core, manually separating the coil windings, or by switching inductors into or out of a tuned circuit, upon command or manually, resulting in additional components, or larger size requirements for tuned circuits.

Even where a single value inductor is used, changes in temperature, for example, may alter the physical characteristics of an inductor in a RF tuned circuit, requiring re-calibration, re-tuning, or even rebuilding the circuit to accommodate the ambient temperature around the inductor.

Therefore, there exists a need to resolve these problems with the prior art and to significantly improve the way the value of inductors in tuned circuits may be altered, without the need to add components to the tuned circuits.

SUMMARY OF THE INVENTION

The invention disclosed according to its inventive principles, permits the use of a single coil as a variable inductor in a tunable circuit. According to the inventive principles as disclosed in connection with the preferred embodiment, a tuned circuit's reactive characteristics, such as frequency, may be altered by changing the circuit's inductance. This change in inductance may be achieved by applying external heat or internal heat to alter the inductor's size and hence, its inductive value. However, as is well known to those of ordinary skill in the art, heat generated in a conductor is proportional to the conductor's series resistance which, in the case of a prior art inductor, is also a measure of the Quality Factor (Q) of a circuit. The higher series resistance reduces circuit Q value and the efficiency of the circuit when it is used as an RF tuning device. According to the inventive principles, an elastic element is used as a support for the inductor. The elastic element is in the shape of an inductor coil and the inductive element is formed as a layer on the elastic coil support. By incorporating the elastic element for supporting and altering the shape of the layered inductor element, as two separate elements in one combined system, with an insulating layer between, the heating of the elastic element does not substantially alter the series resistance of the layered inductor element. The combined system, as shown and described according to the example of the preferred embodiment, uses a elastic material having a memorized state which is created when the coil is being formed. The material of the coil may be of the composition Nickel Titanium (NiTi) and its alloys, as are commercially available. For example, an inductor support may be made in the shape of a coil from NiTi and heated according to manufactures perscription until that coil shaped memory state is set. According to the inventive principles as disclosed in connection with the preferred embodiment, the coil is then coated with an insulator such as polyurethane, as would be known to one of ordinary skill in the art. The insulating coating of polyurethane preserves the elastic properties of the NiTi coil when the conductive element which becomes the operative inductor element, is added to the system as a low resistance conductor, for example in the form of an electroplated gold coating applied to the insulating layer.

The elastic element in the system is the NiTi coil which may be altered in shape for example by sending a heating current through the coil. The RF operative element of the system is the conductive plating incorporated in the system but separated from the heat responsive elastic element by the insulating layer. As would be known to one skilled in the art, high frequency current such as current at radio frequencies travels at the surface of the conductor. As the RF operative element of the system is attached to but insulated from the heated elastic NiTi coil, it changes in shape in response to change in the shape of the NiTi coil but is insulated from the heat produced in the coil. At the same time, because of the insulation, the material used for the operative inductive element in the system can be made of a different material than used as the elastic material, such as a material having the highest conductive properties and least responsive to heat induced resistive changes. In the example shown for the preferred embodiment, the coating is a gold or gold alloy. However, as would be understood by those skilled in the art, other materials may be used in the practice of this invention.

Accordingly, what is shown and described is a system for a heat responsive variable inductance, incorporating an elastic element having a coil shape responsive to changes in applied heat and temperature, with a conductive element layered on the coil and separated from the elastic element by a layer of insulation. The inductive element, formed from a conductor layered on the insulation, is insulated from the elastic heat responsive element and has a shape and inductance responsive to the change in shape of the heat responsive system element.

DETAILED DESCRIPTION OF THE PREFERRED EMBODIMENTS

The invention, according to its inventive principles, is disclosed with reference to the preferred embodiments, as described below.

Figure 1:
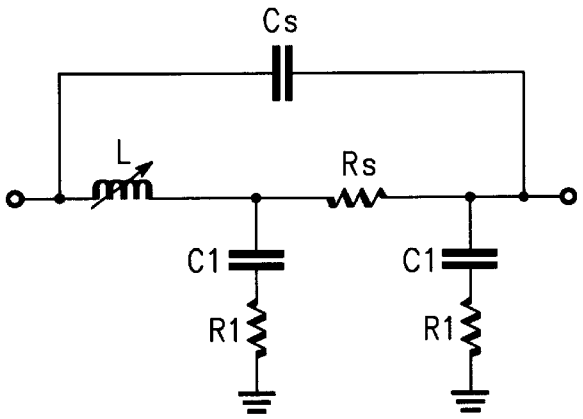
FIG. 1 shows in a schematic form, an equivalent circuit diagram of an inductor as measured by the inventor.

As shown generally in FIG. 1, an inductor implemented in accordance with the preferred embodiment of the present invention is represented by its electrical equivalent model having an inductance L, a series resistance Rs, a coupled capacitance Cs and shunt capacitances C1 in series with shunt resistances R1. Inductance L is shown as a variable inductor, representative of the changes in inductance responsive to changes in temperature, for example.

Figure 2:
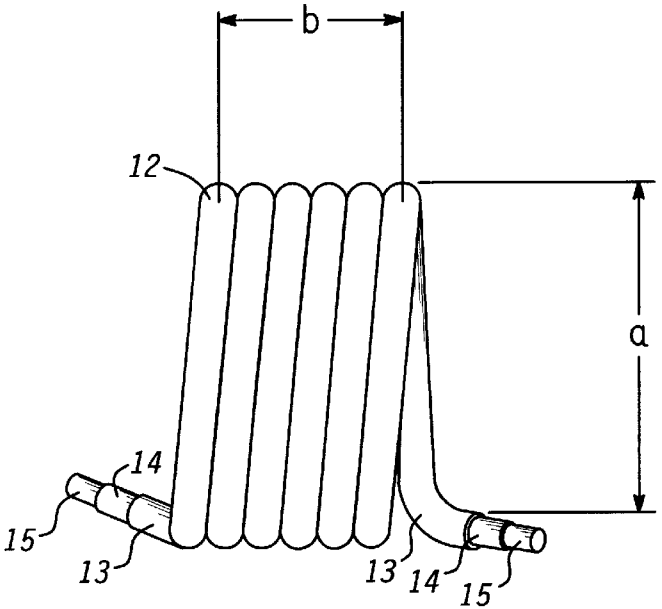
FIG. 2 shows an inductor system made from an elastic material having a memorized state.
Figure 3:
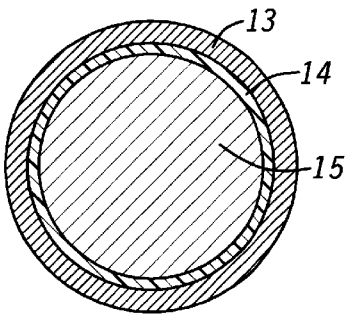
FIG. 3 shows the inductor system of FIG. 2 in cross section.

In FIG. 2, is shown an inductor system 11 as may be made from a memory set elastic material and in its memory state. The inductor system 11 is shown as a coil 12 having a diameter "a" and length "b". The inductor system 11 is made of an elastic element 15, forming the wound coil 12, an insulating layer such as for example polyurethane, 14 and a conductive coating 13, serving as the inductive RF element. The inductor system 11 of FIG. 2 is shown in cross section in FIG. 3, with the same numerals representing the same parts. As shown in FIGS. 2 and 3, the elastic element with the memory state 15 may be made from a material such as Nickel Titanium (NiTi) which may be set by subjecting it to a set temperature for a predetermined time. The inductive element, shown as coating 13, may be plated over an insulator 14 coated on the elastic element 15. The inductive element 13 may be a thin coating suitable for an RF current traveling along the surface of a conductor as known to those of ordinary skill in the art. The inductive element 13 may be made from a highly conductive material such as gold.

Figure 4:
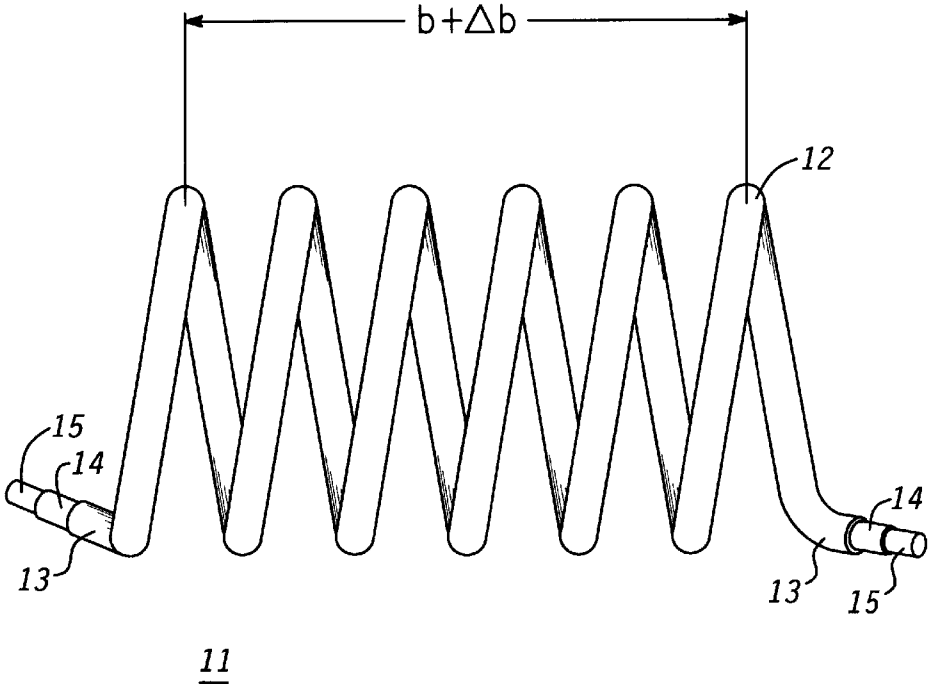
FIG. 4 shows the inductor system of FIG. 2 after its length has been enlarged from its memory state, as for example responsive to external or internal heat applied to the inductor or a current applied to the elastic memory element.

In operation, changing of the inductance of the inductive element 13, may be accomplished by applying heat to the elastic element 15 by passing a current through elastic element 15 or applying heat to the coil 12. The effect of the heat causes the elastic element 15 to lengthen or shorten, thereby changing the length of the coil to b ± delta b, as shown in FIG. 4, changing the inductance of inductive element shown as the layered coating 13. At the same time, the heat applied to the elastic element 15 does not substantially alter the temperature and resistance of the inductive element 13 because of the insulating layer 14 or because the inductive element 13 is made of a thin coating of highly conductive material not susceptible to changes in resistance under the heating of the elastic element 15. In this way, a highly conductive and thermally stable material such as gold may be used in limited amounts as the operative inductive element 13 of the system while an elastic material such as NiTi may be in the form of a coil form to support the length, diameter and the number of turns required for the inductive element formed by conductive coating 13.

Figure 5:
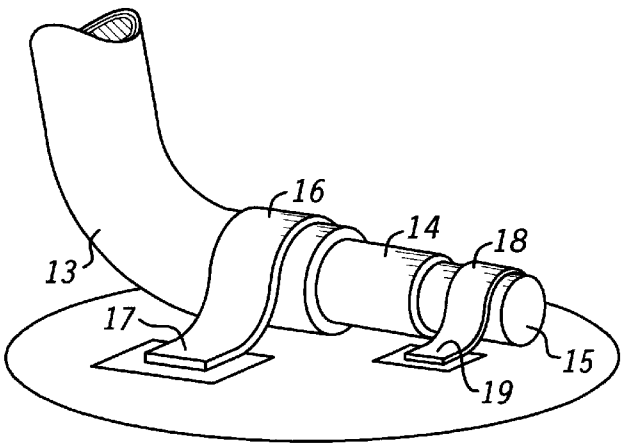
FIG. 5 shows an end of the inductor system with the electrical connections for the elastic element to a source of DC or AC for heating the elastic element and with the electrical connection for the inductive element for connection to an RF circuit element.

The manner of connecting the inductive system may be seen in FIG. 5. An end of the inductive system of FIGS. 2 and 4 is shown with the same numerals representing the same parts. As shown the elastic element 15 of the inductive system inductive coil 12, is made from the elastic material 15. The insulating layer is shown by numeral 14 and the conductive outer coating serving as the inductive element is shown by numeral 13. A conductive strap 16 or other suitable connector as would be known to one skilled in the art, is attached to inductive element 13 and a conductive strap 18 or other suitable connector as would be known to one skilled in the art, is attached to elastic element 15. The surface 17 of conductive strap 16 may be soldered to a solder pad coupled to an RF circuit element. The conductive strap 18 may be soldered or clamped to a source of DC or AC suitable for heating the elastic element and altering its shape. Alternatively, the inductive element 15 can be soldered directly to the solder pad that is coupled to the RF element.

In operation, the system shown and described comprises an elastic element with a memory state and an inductive element whose inductive value is altered responsively to the altered shape of the elastic element. The two system elements are kept separate and electrically insulated by a thin insulating coating. An insulating or protective layer may be added to the conductive layer.

Although specific embodiments of the invention have been disclosed, it will be understood by those having ordinary skill in the art that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. An inductive system comprising:

an elastic element made from an elastic material with a memory state, and formed in the shape of a coil for supporting an conductive element;

an insulating coating on said elastic element; and a conductive coating formed on said insulative coating forming an inductive element;

said insulating coating extending over said elastic element with ends of said elastic element exposed for making electrical connections; and wherein said elastic element is responsive to heat for altering its shape and the inductive value of said inductive element.

2. The inductive system of claim 1, wherein, said elastic element is responsive to heat for changing its length and the length of said inductive system.

3. The inductive system of claim 1, wherein said elastic element is responsive to a current applied to said exposed ends, for heating said elastic element and altering its shape.

4. The inductive system of claim 2, wherein said elastic element changes in length in said response to said heat and said inductive value of said inductive element changes in response to said elastic element changing its length.

5. The system of claim 1, wherein said elastic element is made from nickel titanium.

6. The inductive system of claim 1, wherein said insulating coating extends over said elastic element and between said exposed ends and said inductive element is a coating applied over said insulating coating.

7. The inductive system of claim 1, wherein said insulating coating is a polyurethane.

8. The inductive system of claim 1, wherein said conductive coating is made from gold.

9. The inductive system of claim 1, wherein the material of said elastic element is NiTi and the resistance of said conductive element is substantially the same under said heat applied to said elastic element.

10. An inductive system used in a tuned circuit comprising:

an elastic material having a memory state, made in the shape of an inductive coil having two ends;

an insulating coating applied over said elastic material; with said two ends of said elastic material exposed for making an electrical connection;

a conductive material applied over said insulating material for forming an inductor;

said elastic material made from a conductive material for carrying a current between said two ends for heating said elastic material and for changing its shape and the inductive value of said conductive material; and said conductive material being made of a material having a greater conductivity then the elastic material which maintains its internal resistance and the Q of the tuned circuit, substantially the same in response to said heating of said elastic material.

11. The system of claim 10, where said inductor has connectors at said ends for an electrical connection.

12. The system of claim 10, wherein said elastic material has connectors at said ends for connection to a source of current for heating said elastic material.

13. The system of claim 10, wherein said conductive material is coated over said insulating material.

14. The system of claim 10, wherein said insulating material is coated over said elastic material.

* * * * *